US005256161A

United States Patent [19]

Grütze et al.

[11] Patent Number: 5,256,161

[45] Date of Patent: Oct. 26, 1993

[54] AQUEOUS DYESTUFF PREPARATION: LITHIUM BICARBONATE AND REACTIVE DYE

[75] Inventors: Joachim Grütze, Odenthal; Friedhelm Buse, Belm; Johannes Haas, Grevenbroich, all of Fed. Rep. of Germany; Manfred Hobohm, Singapur, Singapore

[73] Assignee: Bayer Aktiengesellschaft, Leverkusen, Fed. Rep. of Germany

[21] Appl. No.: 875,621

[22] Filed: Apr. 28, 1992

[30] Foreign Application Priority Data

May 1, 1991 [DE] Fed. Rep. of Germany ..... 4114214

[51] Int. Cl.[5] ..... D06P 1/38; D06P 1/673; D06P 3/62

[52] U.S. Cl. ..... 8/527; 8/543; 8/549; 8/618; 8/937; 8/918

[58] Field of Search ..... 8/543, 618, 543, 527, 8/549

[56] References Cited

U.S. PATENT DOCUMENTS

| | | | |
|---|---|---|---|
| 3,993,438 | 11/1976 | Fishwick et al. | 8/532 |
| 4,472,168 | 9/1984 | Gauthier | 8/527 |
| 4,702,744 | 10/1987 | Wolff et al. | 8/527 |
| 4,783,195 | 11/1988 | Steinbeck et al. | 8/527 |
| 4,832,698 | 5/1989 | Ikeou et al. | 8/527 |
| 5,032,140 | 7/1991 | Yamawaka et al. | 8/527 |
| 5,096,458 | 3/1992 | Michna et al. | 8/527 |

OTHER PUBLICATIONS

Chemical Abstract of CH 560,799, p. 64, 1975.

*Primary Examiner*—A. Lionel Clingman
*Attorney, Agent, or Firm*—Sprung Horn Kramer & Woods

[57] ABSTRACT

An improved aqueous dyestuff preparation which is suitable for the dyeing or printing of substrates contains a water-soluble lithium compound and an alkali, in particular sodium hydroxide.

9 Claims, No Drawings

AQUEOUS DYESTUFF PREPARATION: LITHIUM BICARBONATE AND REACTIVE DYE

The invention relates to an aqueous dyestuff preparation having improved solubility and effecting fixation of the dyestuff in the dyeing and printing of reactive dyestuffs.

It is known and customary in the practice of dyeing to use urea or other hydrotropic substances, for example dicyandiamide, as solubility-improving chemicals. Hydrotropic compounds are distinguished by the fact that they compensate intermolecular cohesion forces and thus reduce agglomeration, for example of dyestuffs. This addition has hitherto been necessary, since, although reactive dyestuffs have relatively good water solubility, solubility limits are nevertheless exceeded if high concentrations are used and the dyestuff substantivity is reduced by dissolution of the agglomerates if small concentrations are used. By means of urea, improved solubility and levelness of the dyeing are achieved. In addition to its solubility-improving effect, urea furthermore increases the fixation yield in a large number of printing and continuous dyeing processes. It is assumed that it reduces agglomeration of the dyestuff and thus increases the diffusion properties of the dyestuff molecules.

In addition to urea and any additional dyeing assistants, for example dispersants, fixing alkalies producing, depending on the fixing temperature and the desired fixing time pH values of between about 6 and 12, must be added to the dye liquors. These pH ranges are necessary at the fixing temperatures customary in practice in order to form the covalent dyestuff/fibre bond.

The object of the invention is to provide an improved aqueous dyestuff preparation which substantially or completely replaces urea in the practice of dyeing and printing. Fixation of the dyestuff on the substrate should have the effect that addition of alkalies customary in practice to the liquor used can be omitted.

The invention relates to an aqueous dyestuff preparation for the dyeing or printing of substrates in which are present, per 1000 g of aqueous preparation:

a) 1 to 100, in particular 2 to 80, g of at least one water-soluble lithium compound
b) 0.5 to 150, in particular 5 to 40, g of alkali
c) 0.1 to 200, in particular 1 to 50, g of dyestuff and, if desired,
d) dispersants, complexing agents and nucleation inhibitors.

Preferred lithium compounds are LiOH, $Li_2CO_3$, LiCl and in particular $LiHCO_3$. The $LiHCO_3$ is preferably used in the form of a solution prepared by making a slurry of solid $Li_2CO_3$, followed by treatment with $CO_2$.

In a preferred embodiment, the alkali b) is sodium carbonate, water glass, sodium, mono-, di- or triphosphate, sodium phosphate, sodium bicarbonate or in particular sodium hydroxide. In a further preferred embodiment, the preparation has a pH of 6 to 12, in particular of 8.5 to 12. The dyestuff to be used according to the invention is in particular a dyestuff which is used in a weakly acidic to alkaline range for dyeing or for printing, especially a direct dyestuff and in particular a reactive dyestuff.

Preferably, the preparation according to the invention does not contain any or at least any substantial amounts of hydrotropic substances, such as, in particular, urea, derivatives thereof, ε-caprolactam and dicyandiamide.

The aqueous dyestuff preparation is preferably suitable for the dyeing and printing of cellulose fibres, derivatives thereof, regenerated cellulose and blends with synthetic fibres.

Furthermore, the present invention relates to a process for the dyeing and printing of substrates using dyestuffs which are used for dyeing in a weakly acidic, neutral or alkaline range, characterised in that the dyestuff is used in a preparation according to the invention.

Furthermore, the invention relates to a process for dyeing from a long liquor using a reactive dyestuff, characterised in that a lithium compound to be used according to the invention is added to the liquor used before adding the dyestuff, a dyestuff salt (for example sodium chloride or sodium sulphate) is then added in the usual manner followed by addition of the dyestuff in a concentration customary per se and of the alkali in order to adjust the pH for the dyeing.

This dyeing process can be represented in the form of a diagram as shown below:

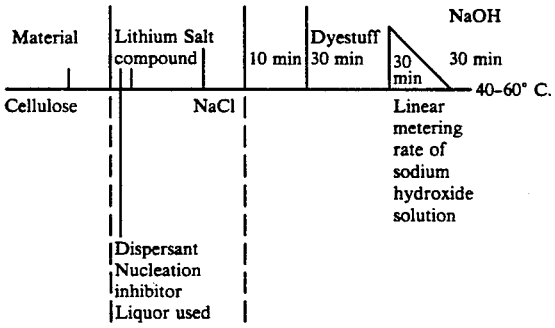

In addition, apart from the lithium compounds according to the invention, the following can be used in the hitherto customary procedure, for example

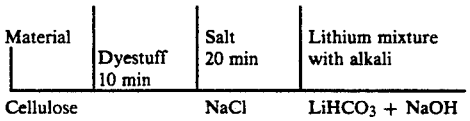

It has been found that solutions of lithium compounds in dye liquors and printing pastes customary in practice have a strong solubility-increasing effect on reactive dyestuffs in the absence of urea or when the amount of urea used is reduced significantly. Furthermore, it has been found that by adding sodium hydroxide solution to the solution of a lithium compound, it is possible to prepare a fixing alkali mixture which makes it possible to omit not only the use of urea but also the use of the amounts of alkali customarily used and to achieve high fixation yields using small amounts of the mixture. The appearance of the dyeings thus obtained can additionally be improved by adding nucleation inhibitors. This addition is preferred in order to prevent precipitations, for example of an $Li_2CO_3$/NaOH mixture.

Accordingly, the mixture according to the invention preferably contains a small proportion of a nucleation inhibitor and possibly of a dispersant.

By using the mixture of lithium compound and sodium hydroxide solution described here, a significant improvement in dyestuff solubility can be observed, especially in combination with the use of crystallisation inhibitors and despite the absence of the amounts of urea otherwise necessary in dye liquors.

The fact that, for example, amounts of urea used of about 200 g/l (solid substance) and about 20 g/l of sodium carbonate can be compensated by amounts used of 3.6 g/l of $LiHCO_3$ and 7 ml/l of NaOH (38° Bé) is unexpected and surprising.

Another surprising fact is that the mixture described not only makes the use of large amounts of urea superfluous but, at the same time, makes it possible to replace the amounts of alkali otherwise customary and achieve high fixation yields.

Thus, the advantage obtained is that reactive dyestuffs, which, due to their limited solubility, can only be used in light to medium colour depths in pad-dyeing processes, obtain an even wider range of use by using the mixture described. At the same time, the substantial amounts of urea used as organic dye assistant can be reduced. Moreover, the liquor according to the invention used is likewise capable of replacing the otherwise customary fixing alkalies. Thus, it has been found that the use of lithium compounds in pad-dyeing liquors, printing pastes and exhaust-dyeing liquors makes the otherwise necessary use of organic hydrotropic compounds for improving the solubility and improving the fixation yield superfluous, substantially reduces the amounts used or, in the absence of solubility-improving substances, improves the dyestuff solubility.

Furthermore, it has been found that the aqueous dyestuff preparation makes it possible to omit the use of the otherwise customary alkali when dyeing by the exhaust method.

Furthermore, it has been found that the aqueous dyestuff preparation makes it possible to reduce the usual high amounts of urea in textile printing to about ⅓.

The aqueous dyestuff preparation contains in particular a reactive dyestuff having at least one fibre-reactive radical Z as the dyestuff.

The process is characterised in that reactive dyestuffs of the formula (I) are used for the dyeing processes according to the invention.

$$D\text{-}[Z]_n \qquad (I)$$

D symbolises the radical of a sulpho-containing dyestuff from the mono- or polyazo, metal complex azo, anthraquinone, phthalocyanine, formazan, azomethine, dioxazine, phenazine, stilbene, triphenylmethane, xanthene, thioxanthone, nitroaryl, naphthoquinone, pyrenequinone or perylenetetracarbimide series.

$[Z]_n$ represents n identical or different reactive radicals, with n being 1 to 4.

Suitable fibre-reactive radicals Z, i.e. those reacting with the OH or NH groups of the fibre under dyeing conditions with the formation of covalent bonds, are in particular those containing at least one reactive substituent bound to a 5- or 6-membered aromatic heterocyclic ring, for example to a monoazine, diazine or triazine ring, in particular a pyridine, pyrimidine, pyridazine, pyrazine, thiazine, oxazine or asymmetrical or symmetrical triazine ring, or to a ring system of this type having one or more fused-on aromatic carbocyclic rings, for example a quinoline, phthalazine, cinnoline, quinazoline, quinoxaline, acridine, phenazine and phenanthridine ring system.

Particularly preferred dyestuffs of this class are dyestuffs of the formula (Ia):

$$D\text{-}Z'_n \qquad (Ia)$$

in which

D has the meaning given in formula (I),

Z' denotes a group of the formula

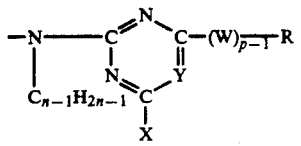

in which

W represents

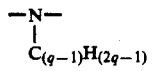

X represents halogen, preferably Cl or F,

Y represents =N—, =CH— or =CX—, n represents 1 or 2, preferably 1, p represents 1 or 2, and q represents 1 to 3, in which, if p is 2, R can be substituted or unsubstituted lower alkyl, phenyl or naphthyl, and, if p is 1, R can be halogen, lower alkoxy or alkoxyalkoxy, substituted or unsubstituted phenoxy or $-NH_2$.

A further preferred class of fibre-reactive dyestuffs are the dyestuffs of the formula (II)

$$D'\text{-}Z''_n \qquad (II)$$

in which

D' is the radical of a metal-free or metal-containing azo, nitro, pyrazolone, thioxanthone, oxazine, anthraquinone, stilbene or phthalocyanine dyestuff or of a tricyclic azo metal complex dyestuff or orthodisazo metal complex having one or more water-solubilising groups, Z is an acyl group of a carboxylic acid having at least one detachable halogen atom, and n is 1 or 2.

Preferred dyestuffs of this class are dyestuffs of the formula (IIa)

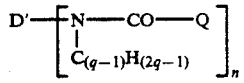

(IIa)

in which

D' and n have the meaning given in formula (II),

Q denotes

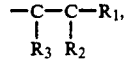

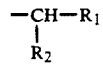

or

-continued $$-\underset{R_3}{\underset{|}{CH}}-\underset{R_2}{\underset{|}{CH}}-R_1$$

in which one or two of the substituents $R_1$, $R_2$ and $R_3$ denote halogen, preferably Br and Cl, and the others are hydrogen, and q denotes the numbers 1 to 3.

Reactive dyestuffs are mainly used on cellulose, which in some cases contains substantial amounts of water-soluble calcium salts, for example calcium chloride, which may originate from the harvest process.

When the hitherto customary fixing alkalies $NaHCO_3$, $NaHCO_3/Na_2CO_3$ and $Na_2CO_3/NaOH$ are used, these calcium salts can form water-insoluble calcium carbonate with the fixing alkalies under the fixation conditions. This calcium carbonate can often be seen on the dyed material as a so-called "grey fog". When the aqueous dyestuff preparation according to the invention is used, this grey fog is not observed, in particular if small amounts of a nucleation inhibitor are additionally used, thus resulting in a "fuller", "more restful" and thus more uniform appearance.

The aqueous dyestuff preparation is particularly suitable for the following areas of application:

Chemical fixing of reactive dyestuffs on cotton, a blend thereof with synthetic fibres and chemical derivatives of cotton, for example staple viscose.

Chemical fixing of reactive dyestuffs on animal fibres, for example wool and silk.

Fixing of reactive dyestuffs on the materials described above by the cold pad-batch method and in pad-dyeing processes carried out continuously at elevated fixation temperature.

Fixing of reactive dyestuffs on the materials described above by the exhaust method f rom a long liquor.

In this area of application, the otherwise customary use of substantial amounts of sodium carbonate (up to 40 g/l, which corresponds to 200 ml of sodium carbonate solution) can be replaced by the alkali solution described in an amount of 60 ml of alkali solution.

The tendency of the dyestuff solutions to separate into the individual components, which is to be observed with other fixing alkalies, can be avoided.

Fixing of reactive dyestuffs on the materials described above in textile printing.

EXAMPLES

The dyestuffs listed below have the following structure:

| Dyestuff No. | Dyestuff |
|---|---|
| 1 | 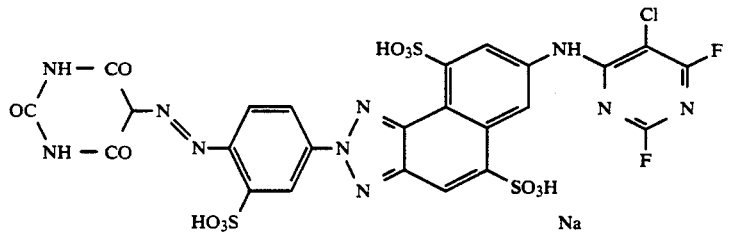 |
| 2 | 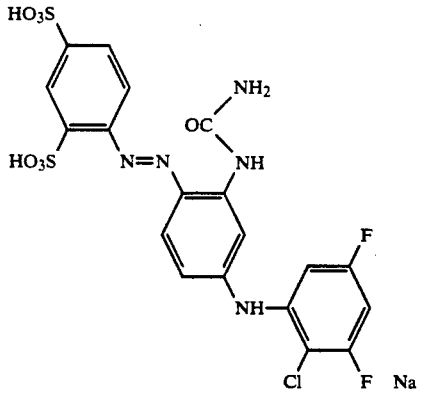 |
| 3 | 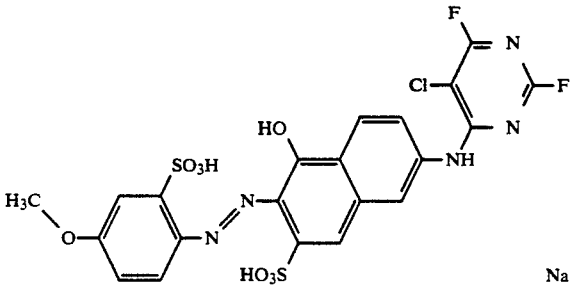 |

-continued
| Dyestuff No. | Dyestuff |
|---|---|
| 4 | 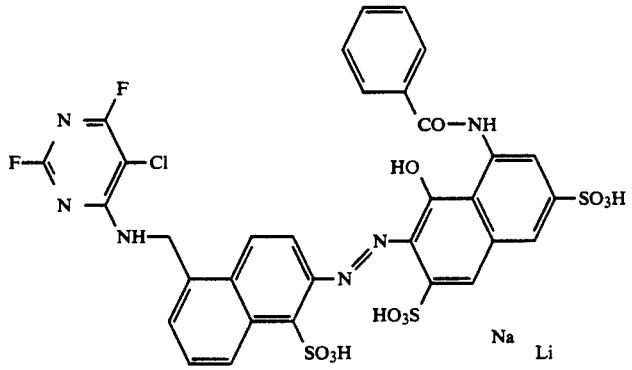 |
| 5 | 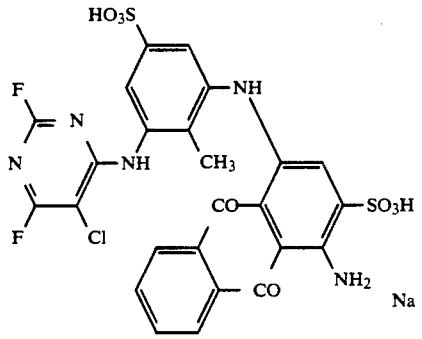 |
| 6 | 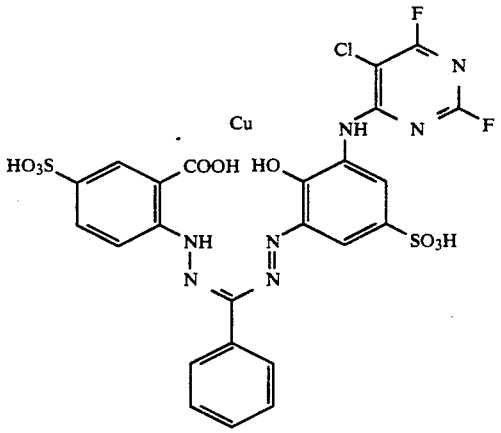 |
| 7 | 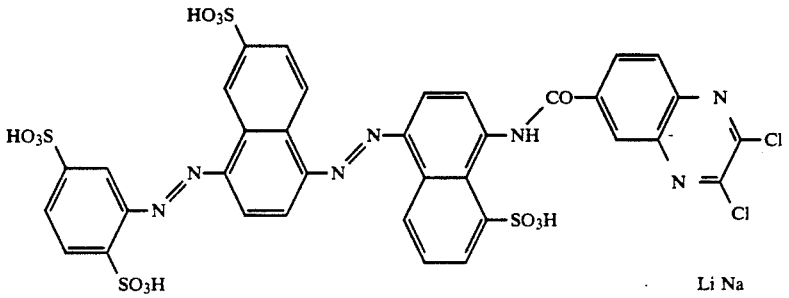 |

-continued

| Dyestuff No. | Dyestuff |
|---|---|
| 8 | 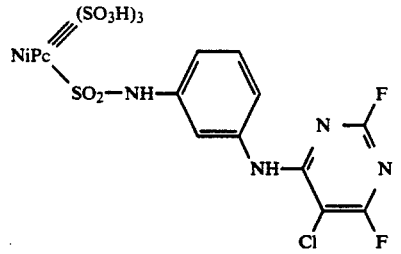 |

DYEING PROCESSES

1. Semicontinuous and continuous processes a) Cold pad-batch method

Defined application of the dye liquor takes place by impregnating the substrate with the reactive liquor used, followed by squeezing off through padding rollers and standing in batched form.

During this batching time, time-dependent fixation of the dyestuffs as a function of the liquor composition takes place at room temperature.

b) Pad-batch method

Application of the aqueous dyestuff preparation takes place as described in a). The batching roller with substrate remains in a closed chamber under defined humidity and temperature conditions.

c) Thermofix process

Application of the aqueous dyestuff preparation takes place as described in a). Uniform drying is then carried out in a drying unit (hot flue), and the dyestuff is fixed by exposure to heat (for example at 150° C. for 30 to 90 seconds).

d) Wet steaming process

Application of the aqueous dyestuff preparation takes place as described in a). Uniform drying is then carried out in a drying unit (hot flue), and the dyestuff is fixed by steaming (for example in saturated steam at 102° C. for 30 to 60 seconds).

1a. Cold pad-batch method (CPB)

When large amounts of dyestuff are used, the application of reactive dyestuffs requires the use of substantial amounts of urea; this is true in particular of medium and deep shades. This amount of urea used depends on the individual solubility of the dyestuff under the conditions in practical application.

Example of a recipe for the hitherto customary procedure and the procedure according to the invention.

| Conventional procedure | | | Procedure according to the invention |
|---|---|---|---|
| Urea | [g/l] | 200 | 0 |
| $Na_2CO_3$ | [g/l] | 20 | 0 |
| NaOH 38° Be' | [ml/l] | 0 | 7 |
| $LiHCO_3$ | [g/l] | 0 | 3.6 |
| Padding assistant | [g/l] | 2 | 2 |
| Dyestuff | [g/l] | 50 | 50 |

In addition to standard amounts used, the following amounts used of dyestuff and chemicals are characteristic:

a) 10 g/l of dyestuff No. 1

-continued

| Conventional procedure | Procedure according to the invention |
|---|---|
| 200 g/l of urea | 50 ml/l of $LiHCO_3$ solution 7.2% strength |
| 20 g/l of sodium carbonate | 7 ml/l of NaOH 38° Be' |
| 2 g/l of padding assistant | 2 g/l of padding assistant |
| | 2 ml/l of nucleation inhibitor |

b) 50 g/l of dyestuff No. 2

| Conventional procedure | Procedure according to the invention |
|---|---|
| 200 g/l of urea | 50 ml/l of $LiHCO_3$ solution 7.2% strength |
| 40 g/l of sodium carbonate | 7 ml/l of NaOH 38° Be' |
| 2 g/l of padding assistant | 2 g/l of padding assistant |
| | 2 ml/l of nucleation inhibitor |

c) 50 g/l of dyestuff No. 3

| Conventional procedure | Procedure according to the invention |
|---|---|
| 200 g/l of urea | 50 ml/l of $LiHCO_3$ solution 7.2% strength |
| 35 g/l of sodium carbonate | 7 ml/l of NaOH 38° Be' |
| 2 g/l of padding assistant | 2 g/l of padding assistant |
| | 2 ml/l of nucleation inhibitor |

d) 80 g/l of dyestuff No. 4

| Conventional procedure | Procedure according to the invention |
|---|---|
| 130 g/l of urea | 50 ml/l of $LiHCO_3$ solution 7.2% strength |
| 40 g/l of sodium carbonate | 7 ml/l of NaOH 38° Be' |
| 2 g/l of padding assistant | 2 g/l of padding assistant |
| | 2 ml/l of nucleation inhibitor |

e) 60 g/l of dyestuff No. 5

| Conventional procedure | Procedure according to the invention |
|---|---|
| 100 g/l of urea | 50 ml/l of $LiHCO_3$ solution 7.2% strength |
| 40 g/l of sodium carbonate | 8 ml/l of NaOH 38° Be' |
| 2 g/l of padding assistant | 2 g/l of padding assistant |
| | 2 ml/l of nucleation inhibitor |

f) 80 g/l of dyestuff No. 6

| Conventional procedure | Procedure according to the invention |
|---|---|
| 150 g/l of urea | 50 ml/l of $LiHCO_3$ solution 7.2% strength |
| 40 g/l of sodium carbonate | 7 ml/l of NaOH 38° Be' |
| 2 g/l of padding assistant | 2 g/l of padding assistant |
| | 2 ml/l of nucleation |

-continued

| | |
|---|---|
| | inhibitor |
| g) 80 g/l of dyestuff No. 7 | |
| Conventional procedure | Procedure according to the invention |
| 200 g/l of urea | 50 ml/l of $LiHCO_3$ solution 7.2% strength |
| 40 g/l of sodium carbonate | 7 ml/l of NaOH 38° Be' |
| 2 g/l of padding assistant | 2 g/l of padding assistant |
| | 2 ml/l of nucleation inhibitor |
| h) 60 g/l of dyestuff No. 8 | |
| Conventional procedure | Procedure according to the invention |
| 200 g/l of urea | 50 ml/l of $LiHCO_3$ solution 7.2% strength |
| 40 g/l of sodium carbonate | 7 ml/l of NaOH 38° Be' |
| 2 g/l of padding assistant | 2 g/l of padding assistant |
| | 2 ml/l of nucleation inhibitor |

The padding assistant is based on ethyl hexyl phosphates in aqueous-alkaline phase.

The nucleation inhibitor is the aqueous solution of 2-phosphonobutane-1,2,4-tricarboxylic acid.

Using these recipes, the following fixation yields are obtained:

TABLE 1

CPB dyeings: conventional method (using urea) compared with an alkali mixture (without urea)
Material: cotton gabardine, bleached; 80%; batching time 24 hours

| | | Relative fixation yield in % (measurement of reflection) | | Effective fixation yield in % (total hydrolysate) | |
|---|---|---|---|---|---|
| Dyestuff No. | | Conventional method using urea | Method according to the invention without urea | Conventional method using urea | Method according to the invention without urea |
| 10 g/l | 1 | 100 | 96 | 84 | 78 |
| 50 g/l | 2 | 100 | 100 | 89 | 87 |
| 50 g/l | 3 | 100 | 100 | 89 | 87 |
| 80 g/l | 4 | 100 | 93 | 88 | 83 |
| 60 g/l | 5 | 100 | 94 | 76 | 73 |
| 80 g/l | 6 | 100 | 98 | 70 | 65 |
| 80 g/l | 7 | 100 | 80 | 80 | 59 |
| 50 g/l | 8 | 100 | 93 | 50 | 45 |

1a. Wet steaming process

| | | Conventional procedure | Invention |
|---|---|---|---|
| a) Urea | [g/l] | 150 | 0 |
| Migration inhibitor | [g/l] | 10 | 10 |
| Padding assistant | [g/l] | 2 | 2 |
| $Na_2CO_3$ | [g/l] | 15 | 0 |
| $LiHCO_3$ | [g/l] | 0 | 3.6 |
| NaOH 38° Be' | [ml/l] | 0 | 7 |
| b) Urea | [g/l] | 150 | 0 |
| Migration inhibitor | [g/l] | 10 | 10 |
| Padding assistant | [g/l] | 2 | 2 |
| $NaHCO_3$ | [g/l] | 20 | 0 |
| $LiHCO_3$ | [g/l] | 0 | 3.6 |
| NaOH 38° Be' | [ml/l] | 0 | 7 |
| Nucleation inhibitor | [ml/l] | 0 | 2 |
| c) Urea | [g/l] | 150 | 0 |
| Migration inhibitor | [g/l] | 10 | 10 |
| Padding assistant | [g/l] | 2 | 2 |
| $NaHCO_3$ | [g/l] | 10 | 0 |
| $NaHCO_3$ | [g/l] | 10 | 0 |
| $LiHCO_3$ | [g/l] | 0 | 3.6 |
| NaOH 38° Be' | [ml/l] | 0 | 7 |
| Nucleation inhibitor | [ml/l] | 0 | 2 |

For these standard recipes, the following amounts of dyestuff used are characteristic:

| | |
|---|---|
| a) 10 g/l | of dyestuff No. 1 |
| b) 50 g/l | of dyestuff No. 2 |
| c) 50 g/l | of dyestuff No. 3 |
| d) 50 g/l | of dyestuff No. 4 |
| e) 50 g/l | of dyestuff No. 5 |
| f) 50 g/l | of dyestuff No. 6 |
| g) 50 g/l | of dyestuff No. 7 |
| h) 50 g/l | of dyestuff No. 8 |

TABLE 2

Wet-steam dyeings: conventional method compared with alkali mixture
Material: cotton gabardine, bleached: liquor pick-up about 72%; steaming time: 90 s at 102° C. (Mathis steamer).

| | | Conventional method: Fixation yield in % 2 g/l of padding assistant 10 g/l of migration inhibitor | | | | Alkali mixture: Fixation yield in % 2 g/l of padding asistant 10 g/l of migration inhibitor |
|---|---|---|---|---|---|---|
| Dyestuff No. | | Urea | 10 g/l of $NaHCO_3$ 10 g/l of $Na_2CO_3$ | 15 g/l of $Na_2CO_3$ | 20 g/l of $NaHCO_3$ | 50 ccm/l of $LiHCO_3$ 7.2% 7 ccm/l of NaOH 39° Be' 2 g/l of nucleation inhibitor |
| 10 g/l | 1 | 200 | 100 | 95 | 95 | 98 |
| 50 g/l | 2 | 200 | 100 | 100 | 96 | 101 |
| 50 g/l | 3 | 200 | 100 | 99 | 96 | 98 |
| 50 g/l | 4 | 100 | 100 | 101 | 94 | 96 |
| 50 g/l | 5 | 100 | 100 | 99 | 86 | 94 |
| 50 g/l | 6 | 150 | 100 | 100 | 99 | 98 |
| 50 g/l | 7 | 200 | 100 | 105 | 84 | 99 |
| 50 g/l | 8 | 200 | 100 | 124 | 86 | 101 |

Dyeing process:
Steaming time: 90 s at 102° C.; 100% humidity.

When the $LiHCO_3/NaOH$ mixture is used, the fixation yields of the reactive dyestuffs tested are in the range customary for the use of urea as solubility-improving and fixation yield increasing auxiliary substance.

With the dye liquors used in practice, occasionally phase separations can be observed during application in the presence of alkali.

After addition of the hitherto customary fixing alkali $Na_2CO_3$ in some cases, the homogeneously mixed dyestuffs separate to some extent into their individual components. This separation can lead to unlevel dyeings.

Replacing the hitherto customary sodium carbonate by the aqueous dyestuff preparation according to the invention avoids separation of the dyestuff mixture, as a result of which better levelness of the dyeing and saving of costs are obtained when the dyestuffs are used.

Moreover, the use of the alkali mixture leads to a very good appearance and very high fixation yields.

The substrate to be dyed is brought into contact with the aqueous dyestuff preparation, during which the material can be stationary (yarn dyeing) or be circulated (piece dyeing). The selective use of electrolyte and alkali and the temperature conditions results in absorption by or fixation on the substrate of the dyestuffs.

Exhaust dyeings: conventional process compared with alkali mixture

Material: cotton knitted fabric bleached: liquor ratio 1:20: dyeing temperature: 50° C.; dyeing time: 90 minutes Alkali mixture:

847 parts of $LiHCO_3$ solution, 7.2% strength 34 parts of nucleation inhibitor 119 parts of NaOH 38° Bé

TABLE 3

| | Conventional process | | | Alkali | Relative fixation yield in % | |
|---|---|---|---|---|---|---|
| Dyestuff No. | g/l of NaCl | g/l of $Na_2CO_3$ | ccm/l of NaOH 38° Be' | mixture ccm/l | Conventional process | Alkali mixture |
| 1% 1 | 40 | 2 | 0.5 | 30 | 100 | 100 |
| 5% 2 | 50 | 4 | 1.0 | 30 | 100 | 100 |
| 5% 3 | 50 | 4 | 1.0 | 30 | 100 | 102 |
| 5% 4 | 50 | 4 | 1.0 | 30 | 100 | 101 |
| 5% 5 | 50 | 4 | 1.0 | 30 | 100 | 100 |
| 5% 6 | 50 | 4 | 1.0 | 30 | 100 | 98 |
| 5% 7 | 50 | 4 | 1.0 | 30 | 100 | 95 |
| 5% 8 | 50 | 4 | 1.0 | 30 | 100 | 105 |

3. Textile printing

If the aqueous dyestuff preparation according to the invention is used in textile printing, the hitherto necessary amount of urea can be reduced to about ⅓ for obtaining a comparable fixation yield, Table 4.

TABLE 4

| | Textile printing: conventional method, compared with alkali mixture and reduced amount of urea<br>Material: cotton nettle fabric, bleached; dried at 90° C. for 10 minutes; fixed at 102° C. for 8 minutes | | | |
|---|---|---|---|---|
| Stock solutions: | with urea | without urea | urea reduction a) | urea reduction b) |
| | 500 g of sodium alginate 4%<br>10 g of anti-reducing agent<br>2 g of complexing agent<br>150 g of urea<br>20 g of sodium bicarbonate<br>278 g of water<br>960 g<br>40 g of dyestuff No. 3 sprinkled in with stirring<br>1000 g | 500 g of sodium alginate 4%<br>10 g of anti-reducing agent<br>2 g of complexing agent<br>50 g of $LiHCO_3$ 7.2%<br>9.5 g of NaOH 38° Be'<br>338.5 g of water<br>960 g<br>40 g of dyestuff No. 3 sprinkled in with stirring<br>1000 g | 500 g of sodium alginate 4%<br>10 g of anti-reducing agent<br>2 g of complexing agent<br>50 g of $LiHCO_3$ 7.2%<br>9.5 g of NaOH 38° Be'<br>25 g of urea<br>363.5 g of water<br>960 g<br>40 g of dyestuff No. 3 sprinkled in with stirring<br>1000 g | 500 g of sodium alginate 4%<br>10 g of anti-reducing agent<br>2 g of complexing agent<br>50 g of $LiHCO_3$ 7.2%<br>9.5 g of NaOH 38° Be'<br>50 g of urea<br>33.5 g of water<br>960 g<br>40 g of dyestuff No. 3 sprinkled in with stirring<br>1000 g |
| Relative fixation yield (reflection) | 100% (= reference) | 70% | 82% | 89% |
| Effective fixation yield | 69% | 38% | 51% | 64% |
| (total hydrolysis) | 100% (= reference) | = 55%* | 74%* | 93%* |

*of reference
Anti-reducing agent: sulphated nitrobenzene
Complexing agent: polyphosphate 2. Exhaust-dyeing process from a long liquor Preparation of the $LiHCO_3$ solution Furthermore, it has been found that the stability of aqueous $LiHCO_3$ solutions can surprisingly be improved if they contain for stabilisation at least one nucleation inhibitor. A particularly suitable nucleation inhibitor is 2-phosphonobutane-1,2,4-tricarboxylic acid.

The preparation of a stabilised $LiHCO_3$ solution is described below by way of example:

34 ml of an aqueous solution of 2-phosphonobutane-1,2,4-tricarboxylic acid are added to 847 ml of a 7.2% strength aqueous solution of lithium bicarbonate at 25° C. over a period of 10 minutes with stirring. 119 ml of a 44.1% strength aqueous solution of sodium hydroxide are then added at 25° C. over a period of 15 minutes with simultaneous cooling and stirring.

Accordingly, for the use of lithium salts described here in wet finishing, the possible uses are as follows:

I. Lithium salts together with alkalies and nucleation inhibitor

1) Textile printing using reactive dyestuffs on cotton
   a) Replacement of a portion of the hitherto used urea
   b) Replacement of all of the hitherto used alkali
2) Pad dyeing using reactive dyestuffs on cotton
   a) Replacement of all the urea in high-temperature processes
   b) Replacement of all of the hitherto used alkali in high-temperature processes
   c) Replacement of all the urea in semicontinuous processes
   d) Replacement of all the alkali in semicontinuous processes
3) Exhaust-dyeing processes of reactive dyestuffs on cotton
   a) Replacement of all the alkali in all processes from a long liquor, preferably at liquor ratios which will be reduced even further in the future.

II. Lithium salt together with nucleation inhibitor without alkali

1) Textile printing using reactive dyestuffs on cotton
   a) Replacement of a portion of the hitherto used urea
2) Pad dyeing using reactive dyestuffs on cotton
   a) Replacement of all the urea in high-temperature processes
   b) Replacement of all the urea in semicontinuous processes
3) Exhaust-dyeing processes of reactive dyestuffs on cotton
   a) Levelling dyeing assistant for improving the appearance using the hitherto used alkali mixtures
   b) Levelling dyeing assistant as additional process auxiliary in the LEVAMETERING process using metering in of sodium hydroxide solution
   c) Levelling dyeing assistant for carrying out the process economically.

We claim:

1. Aqueous reactive dyestuff preparation for dyeing and printing comprising
   a) 1 to 100 g of lithium bicarbonate
   b) 0.5 to 150 g of alkali selected from the group consisting of sodium carbonate, water glass, sodium phosphate and sodium hydroxide
   c) 0.1 to 200 g of reactive dyestuff per 1000 g of aqueous preparation and, optionally
   d) dispersants, complexing agents and nucleation inhibitors.

2. Preparation according to claim 1, characterised in that it has a pH of 6–12.

3. Preparation according to claim 1, characterised in that it is suitable for the dyeing of cellulose fibres.

4. Aqueous lithium bicarbonate solution according to claim 1 containing an effective amount of 2-phosphonobutane-1,2,4-tricarboxylic acid as nucleation inhibitor.

5. Preparation according to claim 1 comprising 2 to 80 g of the lithium bicarbonate, 5 to 40 g of the alkali and 1 to 50 g of reactive dyestuff.

6. Preparation according to claim 1, characterised in that the preparation does not contain any substantial amounts of hydrotropic substances.

7. Preparation according to claim 1 which contains hydrotropic substance selected from the group consisting of urea, derivatives thereof, ε-caprolactam and dicyandiamide.

8. Process for the dyeing and printing of substrates with a dyestuff, wherein a preparation according to claim 1 is used.

9. Process for dyeing from a long liquor using a reactive dye stuff, characterised in that lithium bicarbonate is added to the liquor before adding the reactive dyestuff, then a salt is added followed by addition of the reactive dyestuff and alkali selected from the group consisting of sodium carbonate, water glass, sodium phosphate and sodium hydroxide in order to adjust the dyeing pH to 6 to 12.

* * * * *